United States Patent [19]

Stauffer et al.

[11] 4,196,496

[45] Apr. 8, 1980

[54] COMBING ROLLER

[75] Inventors: Jörg Stauffer, Ettingen; Christoph Burckhardt, Binningen, both of Switzerland

[73] Assignee: Christoph Burckhardt & Co., Switzerland

[21] Appl. No.: 882,318

[22] Filed: Mar. 1, 1978

[30] Foreign Application Priority Data

Mar. 1, 1977 [CH] Switzerland ..... 2559/77

[51] Int. Cl.[2] ..... D01G 19/10

[52] U.S. Cl. ..... 19/97; 29/121.1; 29/123

[58] Field of Search ..... 19/97, 112, 128; 29/126, 123, 121.1, 121.5, 116 R, 129.5, 121.8; 26/37; 15/179, 181, 198, 200; 125/5; 17/18, 64, 67

[56] References Cited

U.S. PATENT DOCUMENTS

| | | | |
|---|---|---|---|
| 444,675 | 1/1891 | Seror | 15/198 X |
| 1,775,392 | 9/1930 | Gray | 29/126 X |
| 2,636,221 | 4/1953 | Meadows et al. | 29/116 R |
| 3,938,310 | 2/1976 | Didek et al. | 19/105 X |
| 4,028,783 | 6/1977 | Buck | 29/123 |

FOREIGN PATENT DOCUMENTS

| | | | |
|---|---|---|---|
| 502135 | 3/1939 | United Kingdom | 29/119 |

*Primary Examiner*—Werner H. Schroeder
*Attorney, Agent, or Firm*—Finnegan, Henderson, Farabow, Garrett & Dunner

[57] ABSTRACT

A combing roller including a reversible pinned ring, a ring core and a cover plate mounted on the ring core, the ring core and the cover plate having operating surfaces for mutually supporting the ring, and a plurality of tightening elements radially spaced in the core and plate adjacent the operating surfaces for securing flanges on the plate and core against the edges of the width of the ring. Preferably the width of the ring is greater than the combined widths of the operating surfaces.

11 Claims, 6 Drawing Figures

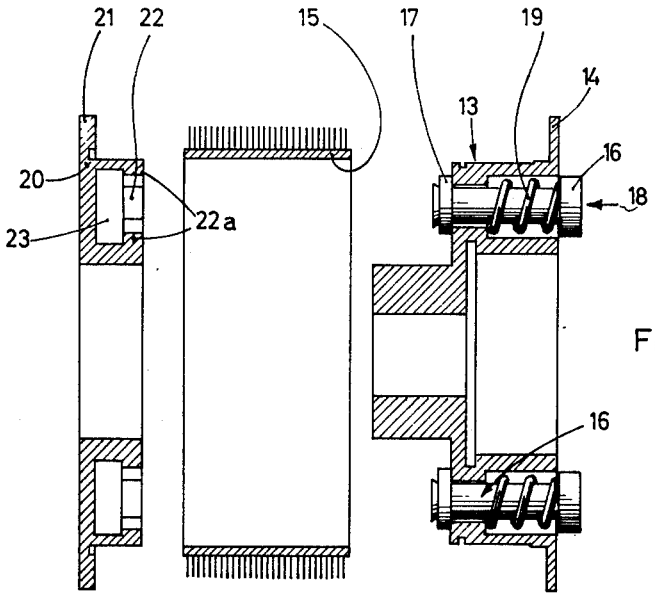
FIG. 4
FIG. 5
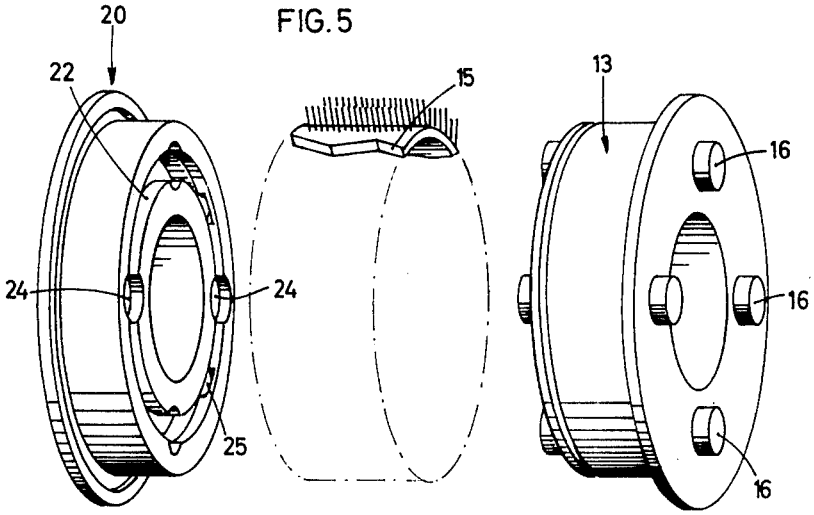
FIG. 6
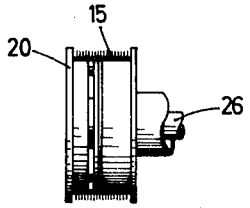

COMBING ROLLER

The present invention relates to a combing roller for open-end spinning machines with a cylindrical ring which has pins or a saw-tooth set on its circumference and which is arranged on a rotating, driveable ring core.

BACKGROUND OF THE INVENTION

It is known that for open-end spinning, the cleaned and pre-drawn fibres which are for example in the form of "sliver" must be combed, i.e. they must be separated so that adjacent fibres do not cling together. The known combing rollers developed for this purpose generally comprise a combing means, i.e. a pinned ring or saw-tooth set which is secured to a core and usually pressed on to the same. These known combing rollers, however, have the disadvantage that, when a certain state of abrasion is reached, they must be removed from operation completely and replaced by new rollers. Also, the roller cores, which only undergo minimal wear and tear during the combing process, cannot be used again with the known structures.

A further disadvantage of the known combing rollers is that their combing means cannot be removed and replaced the other way round, i.e., are not reversible, and the working angle of the pins cannot therefore be changed.

These disadvantages are overcome with the present invention in that, for the purpose of replacement, the ring is located loosely on the ring core with one cylindrical take-up surface and is held in this position by a cover which is detachably fixed to the ring core.

BRIEF DESCRIPTION OF THE DRAWING

Two embodiments of the subject matter of the invention are shown in the attached drawing.

FIG. 4 shows an exploded view of a variation of the combing roller in cross-section;

FIG. 5 is a perspective view of the variation of FIG. 4; and

FIG. 6 shows the respective combing roller in assembled form.

DESCRIPTION OF THE PREFERRED EMBODIMENT

Figure 1:
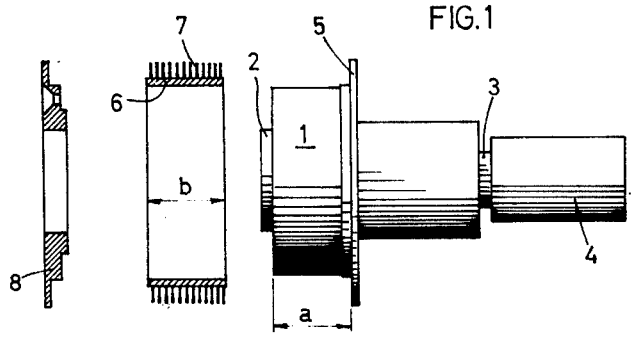
FIG. 1 shows a first embodiment of a combing roller in dismantled form.
Figure 3:
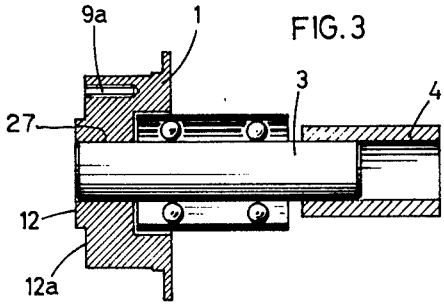
FIG. 3 is a cross-section of the ring core.

The combing roller shown in FIG. 1 comprises a ring core 1 which sits on the end 27 (FIG. 3) of a shaft 3 arranged rotatingly on an antifriction bearing. The shaft 3 can comprise, on its end section away from the ring core 1, a belt pulley 4 which can serve to drive the shaft by means of an endless driving organ. The ring core preferably made of aluminium has a ring flange 5 on the one side.

The actual combing means of the combing roller shown is, in the present embodying example, a pinned ring 6 which has separating pins 7 on its circumference. The ring 6 is proportioned so that it can be pushed onto the ring core 1 and so that, in this position, it protrudes beyond the ring core. The width a of the ring core is thereby kept somewhat smaller than the width b of the brass ring 6.

Figure 2:
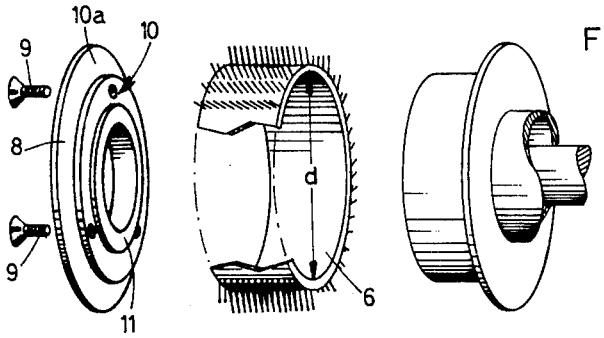
FIG. 2 is an oblique perspective view of the same embodiment.

To secure the ring 6 on the ring core 1, an annular cover 8 is provided which can be screwed onto the ring core by means of the screws 9 (FIG. 2). The bores 9*a* (FIG. 3) for the screws 9 on the ring core are preferably on the circumference area of the ring core, i.e. on a circle lying symmetric with the rotation axis of the ring core, the distance of which from said rotation axis being a multiple of its distance from the circumference area of the ring core which carries the pinned ring 6.

On the front area facing the pinned ring 6, the cover 8 has a centralizing shoulder 10 having a diameter equal to the inner diameter d of the pinned ring which serves to hold the pinned ring 6 central. The outer annular flange 10*a* extending beyond the ring shoulder 10, in the assembled state, thereby presses the combing roller onto the front surface of the pinned ring 6 so that this is fixed between the annular flange 10*a* of cover 8 and the ring flange 5.

The surface of the ring core 1 facing the cover 8 is formed on a cylindrical shoulder 2 in which the annular cover 8 is slidably mounted. The surface of the ring cover 1 facing the cover 8 is thereby divided into a surface 12 of the cylindrical shoulder 2, and an annular surface 12*a* facing the cover surface 10*a*.

As already mentioned, the screws 9 and the corresponding bores 9*a* are put as far as possible into the periphery of the ring core 1 in order to avoid deformation which can, according to past experience, easily occur in the circumference area of the cover 8. After tightening of the screws 9 it can still happen that the outer annular flange 10*a* of the cover 8 tilts slightly in the direction of the cover circumference under the tension of the screws. In order to avoid this, a second ring shoulder 11 is arranged on the inner surface of the cover, this shoulder being supported in the installed state of the cover by a circular surface 12*a* (FIG. 3) of the ring core 1. This assures that the circumference area of the cover 8 can not deflect to any large extent when the screws 9 are tightened.

A second embodiment is shown in FIGS. 4 to 6.

This embodiment also shows a ring core 13 which has a ring flange 14 on one side for one-sided support of a pinned ring 15. In this case, the ring core 13 comprises elastic holding means 16 which are arranged so that they can be axially moved in respective bores of the ring core. On one end section, the holding means 16 have disc-shaped anchoring members 17 which serve at the same time in the position shown as stops. The holding means shown can thereby be moved in the direction of arrow 18 axially against the biasing force of a spring 19.

A cover marked 20 in this embodiment is also provided with a ring flange 21 for holding the pinned ring 15. This cover has a circular groove 22 which leads into a further, slightly wider circular groove 23. Equalling the number of holding means 16 on the ring core, there are four symmetrically arranged bores in a circle in the groove 22, the diameter of these bores equalling that of the stop members 17. The stop members 17 can then be inserted into the lower wider groove 23 through the openings 24 whereupon the cover is turned in relation to the ring core until the stop members 17 snap into respective slots 25 behind flanges 22*a* and are held in this position by the helical springs 19. Now the pinned ring 15 is securely anchored on the ring core.

To release the pinned ring, it is sufficient to press the holdng means 16 against the biasing force of the springs 19 inwards and to turn the cover 20 in relation to the ring core until the stop members 17 lie in the area of the openings 24. Now the cover can be pulled off the ring core.

FIG. 6 shows the mounted combing roller with the driving shaft 26.

The pins of the pinned ring 6 (FIG. 1) and 15 (FIG. 4) are exactly radial or form a certain angle with the respective radius. Thanks to being able to change the pinned rings, it is possible to remove the pinned ring and replace it the other way round, i.e., reverse it, and obtain thereby another working angle of the pins (positive or negative).

What we claim is:

1. A combing roller for an open-end spinning machine, the combing roller comprising:

a ring core having a cylindrical operating surface of a predetermined width, a ring flange extending radially therefrom, and an integral cylindrical shoulder of smaller diameter than said cylindrical operating surface;

a reversible ring having combing means extending outwardly therefrom, said ring being slidably mounted on said operating surface to abut said ring flange of said ring core and having a width extending beyond said predetermined width;

an annular cover plate for mounting on said cylindrical shoulder said plate having a first circular shoulder forming an operating surface for slidably receiving at least a portion of said extending width and an annular flange for abutting an edge of said extending width of said reversible ring; and means interacting between said core and said plate for applying pressure on the edges of the width of said ring by urging said plate toward said ring core for securing said ring from movement relative to said operating surfaces, said securing means including tightening means radially spaced from and about the longitudinal axis of said core and said plate, adjacent to said operating surfaces.

2. A combing roller according to claim 1 in which said tightening means includes screws.

3. A combing roller according to claim 1 in which said tightening means includes spring-biased rods.

4. A combing roller according to claim 3 wherein said rods have first stop members on one end slidably mounted in said core, said spring-bias being between said first stop members and said core, and second stop members on the other ends of said rods for releasably engaging said plate.

5. A combing roller according to claim 4 wherein said cover plate includes an annular groove aligned with said radially spaced rods, said groove having a T-shaped cross section for securing said second stop members in said groove, and spaced openings intersecting said groove for admitting said second stop members into the groove, whereby rotation of said plate relative to said core secures said second stop member in said groove against the bias of said springs.

6. A combing roller according to claim 5 wherein the T-shaped cross section of said groove is formed by inwardly extending flanges and wherein said flanges include slots in their inner surfaces complementary in shape to said second stop members for receiving said second stop members during said relative rotation for releasably securing said plate from further rotation with respect to said core.

7. A combing roller according to claim 1 in which the width of the ring is greater than the combined widths of said operating surfaces.

8. A combing roller according to claim 1 in which said combing means comprises an array of pins.

9. A combing roller according to claim 8 in which said pins extend radially from said reversible ring.

10. A combing roller according to claim 8 in which said pins extend from said reversible ring at an angle to the radii.

11. A combing roller according to claim 7 in which said first shoulder has protruding therefrom a second shoulder for abutting said core.

* * * * *